US008177392B2

(12) United States Patent
Tarko et al.

(10) Patent No.: US 8,177,392 B2
(45) Date of Patent: May 15, 2012

(54) LIGHT STRIP INCLUDING A CORE LAYER OF INSULATING MATERIAL RECEIVING SPACED APART LIGHT EMITTING DIODES

(76) Inventors: Norm Tarko, Kimberly (CA); Pei Wang, Winnipeg (CA)

( * ) Notice: Subject to any disclaimer, the term of this patent is extended or adjusted under 35 U.S.C. 154(b) by 410 days.

(21) Appl. No.: 12/474,455

(22) Filed: May 29, 2009

(65) Prior Publication Data

US 2009/0296395 A1 Dec. 3, 2009

Related U.S. Application Data

(60) Provisional application No. 61/057,063, filed on May 29, 2008.

(51) Int. Cl.
*F21S 4/00* (2006.01)
*F21V 21/32* (2006.01)

(52) U.S. Cl. ..... 362/249.04; 362/800

(58) Field of Classification Search ..... 362/249.02–249.04, 800
See application file for complete search history.

(56) References Cited

U.S. PATENT DOCUMENTS

| | | | | |
|---|---|---|---|---|
| 5,404,282 | A | 4/1995 | Klinke et al. | |
| 5,559,681 | A | 9/1996 | Duarte | |
| 6,074,074 | A * | 6/2000 | Marcus | 362/240 |
| 6,126,303 | A * | 10/2000 | Gross | 362/544 |
| 6,673,292 | B1 * | 1/2004 | Gustafson et al. | 264/149 |
| 6,866,394 | B1 * | 3/2005 | Hutchins et al. | 362/192 |
| 7,207,693 | B2 * | 4/2007 | Ratcliffe | 362/236 |
| 7,303,315 | B2 * | 12/2007 | Ouderkirk et al. | 362/294 |

FOREIGN PATENT DOCUMENTS

CA 2428723 11/2004

* cited by examiner

*Primary Examiner* — Alan Cariaso
(74) *Attorney, Agent, or Firm* — Ryan W. Dupuis; Kyle R. Satterthwaite; Ade & Company Inc.

(57) ABSTRACT

A light strip comprises an elongate core layer of insulating material having a plurality of light mounting apertures extending through the core layer between the two opposed faces of the core layer and receiving respective light emitting diodes therein. Two conductive elements extending in the longitudinal direction along the outer surface of the elongate core layer between which the light emitting diodes are connected. A cover layer spans in the longitudinal direction adjacent each one of the two opposed faces of the elongate core layer to enclose opposing ends of the light mounting apertures with the light emitting diodes therein.

17 Claims, 4 Drawing Sheets

LIGHT STRIP INCLUDING A CORE LAYER OF INSULATING MATERIAL RECEIVING SPACED APART LIGHT EMITTING DIODES

This application claims the benefit under 35 U.S.C. 119(e) of U.S. provisional application Ser. No. 61/057,063, filed May 29, 2008.

FIELD OF THE INVENTION

The present invention relates to a light strip of the type comprising a plurality of light emitting diodes connected at longitudinally spaced positions between a pair of longitudinally extending conductive elements, and more particularly relates to a method of forming the light strip.

BACKGROUND

Light strips comprising a plurality of lights supported at spaced positions along an elongate strip are known to be desirable in many locations, for example for aesthetics, for highlighting an edge or for illuminating the perimeter of an object for example. Light emitting diodes (LED's) are commonly used where it is desirable to consume minimal electrical power with minimal manufacturing cost. A typical construction involves two conductive bands supported in a common plane with light emitting diodes connected in parallel between the bands in a generally common plane therewith. The thickness of the LED's are typically greater than the conductive bands so that when coated with a suitable sealer, the sealer must follow the irregular profile of the LED's protruding from the plane of the conductive elements at spaced positions along the strip. Accordingly it is awkward to adequately seal and protect the lights protruding from the flat plane of the conductive elements unless a particularly large surrounding casing of material fully surrounds all of the conductive elements and the light emitting diodes, resulting in a relatively wide strip compared to the individual components thereof which further requires a relatively large amount of casing material to fully surround and protect the components.

Canadian patent application 2,428,723 by Lin discloses an example of an elongate light strip in which two conductive elements are received between two layers of insulating plastic material. Apertures are provided in one of the layers solely for providing connection of LED's mounted externally on the layers to the two conductive elements received between the layers. The externally mounted LED lights are substantially unprotected even when coated as the resulting LED and coating protrudes upwardly beyond the upper surface of the light strip such that any pressure applied to the upper surface of the light strip is concentrated on the protruding LED's.

Furthermore application of a coating typically requires application at high temperature and pressure to the LED's already mounted in connecting with conductive elements.

The heat and pressure of applying the coating such that the coating bonds well can be very damaging to the small conductive connections and small components of the light strip.

U.S. Pat. No. 5,559,681 by Duarte discloses a modular lighting system comprising flexible strips of lights in which the lights are somewhat protected within a surrounding housing, however the light strip requires formation of multiple individual components which are uniquely molded in shape such that manufacturing can be comparatively expensive and assembly can be awkward and difficult to automate. Furthermore recessing the lights within surrounding strips of material requires a plurality of individual lenses to be mounted in the upper layer where the lenses then protrude from the top surface of the light strip such that any pressure applied to the light strip is concentrated on the protruding components which can result in damage to the lights mounted within the housing.

U.S. Pat. No. 5,404,282 by Klinke et al. discloses a multiple light emitting diode module in which the individual LED's are taught to be mounted within their own respective cores of surrounding protective material separate from one another such that a complex arrangement of a surrounding supporting structure and housing is required to support the individual cores of material relative to one another. The resulting structure is quite large and complex, and accordingly is much more expensive to manufacture than the light strips noted above such that it is not particularly relevant to efficient manufacturing of a low cost light strip as in the present invention.

SUMMARY OF THE INVENTION

According to one aspect of the present invention there is provided a light strip comprising:

an elongate core layer of insulating material having an outer surface comprising two opposed faces extending in a longitudinal direction of the core layer;

at least one light mounting aperture extending through the core layer between the two opposed faces of the core layer;

two conductive elements extending in the longitudinal direction along the outer surface of the elongate core layer;

a plurality of light emitting diodes connected between the two conductive elements and received in said at least one light mounting aperture in the core layer; and a cover layer spanning in the longitudinal direction adjacent each one of the two opposed faces of the elongate core layer.

According to a second aspect of the present invention there is provided a method of forming a light strip comprising:

providing an elongate core layer of insulating material having an outer surface comprising two opposed faces extending in a longitudinal direction of the core layer;

supporting two conductive elements to extend in the longitudinal direction along the outer surface of the core layer;

forming at least one light mounting aperture extending through the core layer between the two opposed faces of the core layer mounting a plurality of light emitting diodes in said at least one light mounting aperture;

connecting each light emitting diode between the conductive elements; and providing a cover layer spanning in the longitudinal direction adjacent each one of the two opposed faces of the elongate core layer.

By providing light emitting diodes which are received within a light mounting aperture within a core layer and locating the conductive elements to lay flat against opposing sides of the core so that the LED's are received between the conductive elements, the open ends of the apertures can be enclosed by a thin and readily placed casing material applied in layers extending along the flat opposed sides of the core with the light emitting diodes being fully recessed and protected within the core between the conductive elements. Accordingly with minimum coating material the resulting strip is much narrower and includes no protruding components as compared to prior art configurations of light strips. Furthermore, the core layer and the cover layer can be formed of readily available preformed strips of material so that no new molding dies are required and manufacturing cost is a minimum.

Preferably the plurality of light emitting diodes are connected in parallel with one another between the conductive elements on the two opposed faces of the core with a resistor being connected in series with each light emitting diode between the two conductive elements.

Preferably there is provided a plurality of light mounting apertures spaced apart from one another in the longitudinal direction of the core layer with each light mounting aperture locating one of the light emitting diodes therein.

The resistor associated with each light emitting diode may be mounted within a respective mounting aperture extending through the core layer independently of the light mounting aperture of the respective light emitting diode.

A conductive member connecting each light emitting diode with the respective resistor connected in series therewith preferably lies in a plane between the core layer and one of the cover layers adjacent thereto.

When the conductive elements each comprise a flat strip of conductive material, preferably all of the conductive members connected between the light emitting diodes and the respective resistor lie in a substantially common plane with the conductive elements between the core layer and one of the cover layers adjacent thereto.

A conductive member connecting each light emitting diode to each one of the conductive elements, preferably lies in a plane between the core layer and one of the cover layers adjacent thereto.

When the conductive elements each comprise a flat strip of conductive material, preferably all of the conductive members connecting the light emitting diodes to the conductive elements lie in a substantially common plane with the conductive elements between the core layer and one of the cover layers adjacent thereto.

Each one of the conductive elements comprises a flat strip of conductive material lying flat against one of the two opposed faces of the elongate core layer. Preferably the conductive elements lie in a substantially common plane between the core layer and one of the cover layers adjacent thereto.

Preferably each light emitting diode is fully recessed between the two opposed faces of the core layer.

The two opposed faces may have a thickness therebetween that is near a maximum dimension of the light emitting diodes.

The core layer may be generally flat wherein a width of the core layer in a lateral direction along the faces perpendicular to the longitudinal direction is many times greater than a thickness of the core layer between the two opposed faces.

Each cover layer preferably comprises a preformed strip of material attached to the respective face of the core layer.

When the cover layers each comprise a continuous strip of material spanning in the longitudinal direction, preferably each light mounting aperture is enclosed at both opposed faces of the core layer by the cover layers spanning thereacross respectively.

The core layer and both cover layers may have a similar width in a lateral direction along the faces of the core layer perpendicular to the longitudinal direction.

The cover layers preferably each have a smaller thickness than a thickness of the core layer between the two opposed faces thereof.

Preferably the core layer and both cover layers are formed of flexible insulating material.

The method may include fully recessing each light emitting diode between the two opposed faces of the core layer.

The method may also include applying the cover layers to the core layer with the conductive elements therebetween so as to define flat finished outer surfaces between which the light emitting diodes are mounted.

The cover layers may comprise a water-resistant material, a chemical-resistant material, and/or an impact-resistant material, to confer the corresponding protection as desired or required, whether same be protection against damage from physical impact, moisture, and/or chemicals, during manufacture and/or routine usage of the light strip.

The method preferably includes forming the light mounting apertures extending through the core layer prior to mounting the conductive elements on the core layer.

Each light emitting diode may be connected with a respective resistor prior to insertion of the light emitting diode into the core layer.

According to another aspect of the invention there is provided a method of forming a light strip comprising:

providing an elongate core of insulating material having two opposed faces extending in a longitudinal direction of the core;

supporting a conductive element to extend in the longitudinal direction along each of the two opposed faces of the core;

providing a plurality of light emitting diodes;

forming a light mounting aperture extending through the core between the two opposed faces of the core in association with each one of the plurality of light emitting diodes;

locating the light mounting apertures at spaced positions in the longitudinal direction of the core;

mounting each light emitting diode in a respective one of the light mounting apertures in the core;

connecting each light emitting diode between the conductive elements in series with a resistor.

According to a further aspect of the present invention there is provided a light strip comprising:

an elongate core of insulating material having two opposed faces extending in a longitudinal direction of the core and a plurality of light mounting apertures extending through the core between the two opposed faces of the core;

a conductive element extending in the longitudinal direction of the core along each of the two opposed faces of the core;

the light mounting apertures being spaced apart from one another in the longitudinal direction of the core;

a light emitting diode mounted in each one of the light mounting apertures in the core;

each light emitting diode being connected between the conductive elements in series with a resistor.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
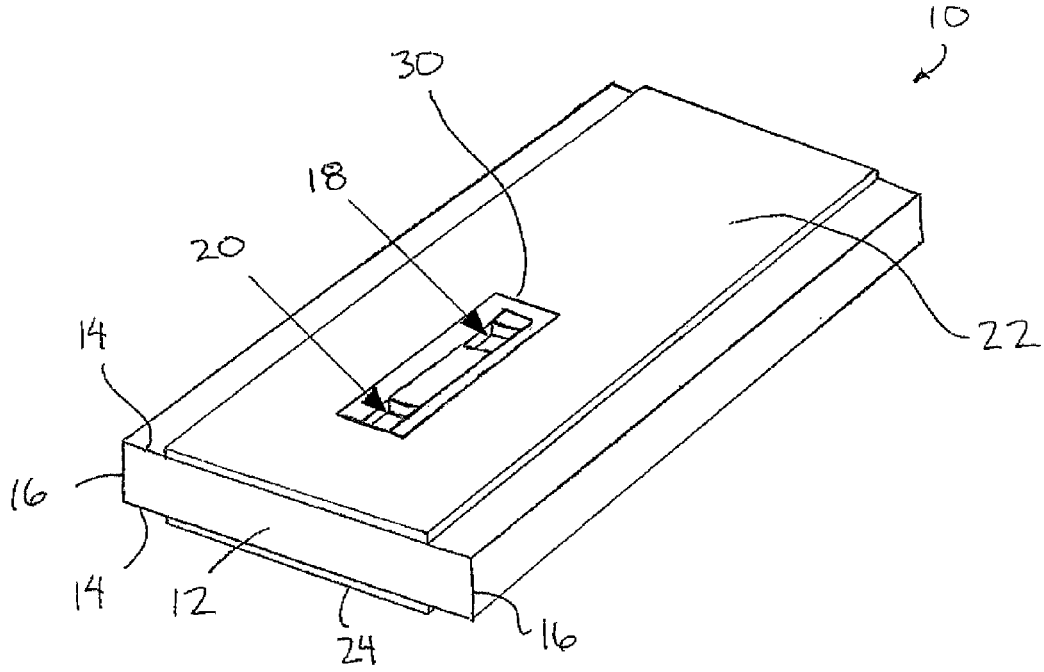
FIG. 1 is a perspective view of a first side of the light strip.
Figure 2:
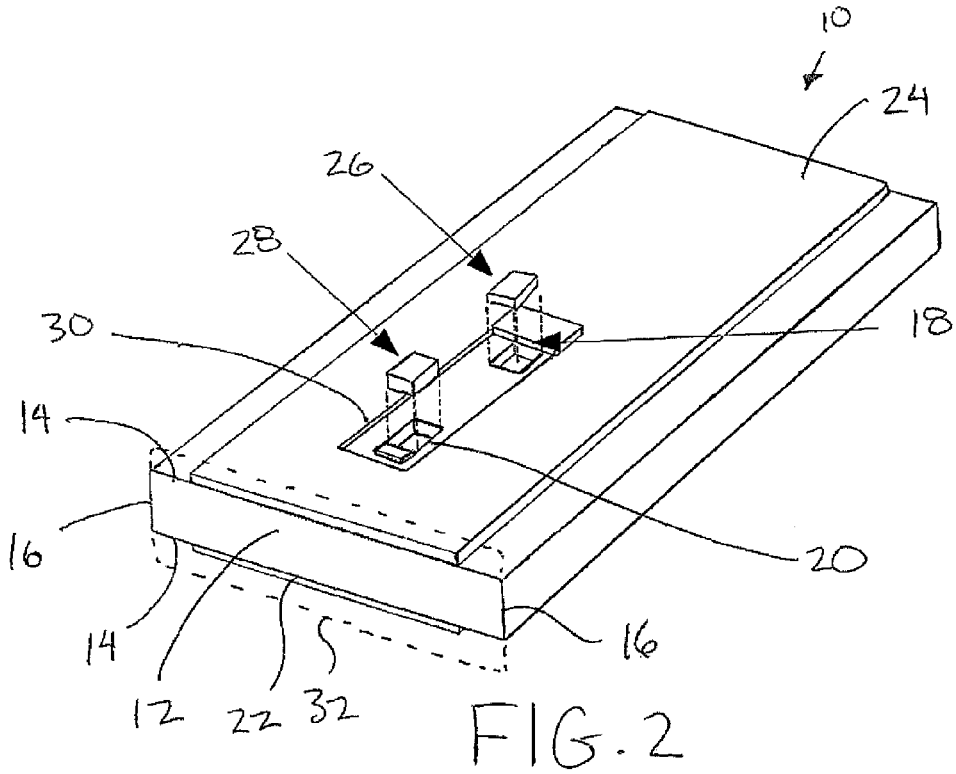
FIG. 2 is a perspective view of the opposing flat side of the light strip prior to application of a casing material.
Figure 3:
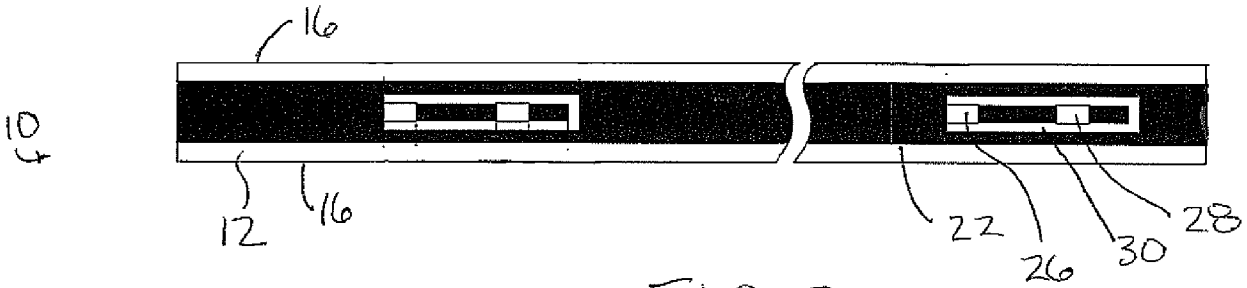
FIG. 3 is a top plan view of one side of the light strip.
Figure 4:
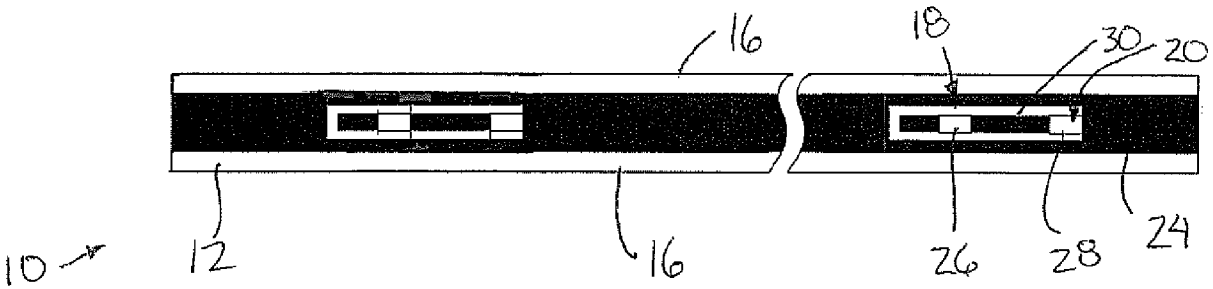
FIG. 4 is a bottom plan view of the opposing side of the light strip.

Referring to the accompanying FIGS. 1 though 4 there is illustrated a light strip generally indicated by reference numeral 10. The strip 10 includes a core which forms the main body of the light strip. The core 12 extends in a longitudinal direction of the light strip and has a generally rectangular cross section defining two flat opposed faces 14 which extend in the longitudinal direction of the core and two much narrower edges 16 spanning between the two faces 14 along opposing edges thereof. The height of the edges 16 corresponding to the space between the two opposed faces 14 is much smaller than the overall width of the faces in a lateral direction between the two edges 16 so that the lateral width of the faces 14 is plural times greater than the space between the two faces as defined by the height of the edges 16.

The core 12 is elongate and formed of insulating material such as a polymer for example.

A plurality of light mounting apertures 18 are provided at spaced locations in the longitudinal direction along the core 12 of the light strip. Each light mounting aperture 18 extends fully through the core between the two opposed faces 14 at a location which is laterally centered between the two edges 16 of the core. Accordingly the light mounting apertures 18 are evenly spaced apart along the center of the core in alignment with one another in the longitudinal direction. Adjacent each light mounting aperture 18 there is also provided a resistor mounting aperture 20 in the core which extends similarly fully through the core between the two opposed faces 14 centrally spaced between the two edges 16 thereof in the lateral direction. The resistor mounting apertures 20 are accordingly similarly spaced apart in the longitudinal direction of the core of the strip.

An upper conductive element 22 and a lower conductive element 24 are provided for spanning along the two faces 14 of the core respectively in the longitudinal direction thereof. Each of the conductive elements comprises a flat band of conductive material mounted flat against the respective one of the two opposed faces 14 of the core so that the two conductive elements are accordingly parallel and spaced apart from one another by the thickness of the core between the two faces thereof. Width of the conductive elements in the lateral direction is near to but slightly less than the width of the core so that the core projects laterally outward beyond the side edges of each of the conductive elements. The conductive elements are secured to the corresponding faces 14 of the core by suitable adhesive means.

Each light mounting aperture 18 includes a light emitting diode 26 received therein for connection between the two conductive elements such that all of the light emitting diodes are connected in parallel with one another. Thickness of the core between the two opposed faces 14 is arranged to be near or slightly greater than a maximum dimension of the light emitting diodes so that the light emitting diode can be fully recessed within the corresponding aperture.

A resistor 28 is received within each of the resistor mounting apertures 20 in the core. Each resistor mounting aperture 20 is located directly adjacent a corresponding light mounting aperture so that each resistor 28 can be connected in series with a respective one of the LED's 26 with which it is associated. The resistors 28 are similarly fully recessed between the two opposed faces of the core and accordingly between the two conductive elements mounted on the faces 14 respectively.

For ease of assembly a conductor aperture 30 is formed in each of the two conductive elements 22 and 24 at each of the light emitting diodes 26 in alignment with the light emitting diode and the respective resistor 28 associated therewith. The dimensions of the conductor apertures 30 are arranged to be greater in both the lateral and longitudinal directions of the light strip than the combined light mounting aperture 18 and resistor mounting aperture 20 associated therewith.

Each light emitting diode 26 is arranged to be connected with a respective one of the conductive elements and to the resistor 28, while the associated resistor is connected between the associated light emitting diode and the other one of the two conductive elements at the opposing face 14 of the core.

Once the light emitting diodes and resistors are connected between the two conductive elements secured to the opposing faces 14 of the core 12, a coating 32 is provided on the exterior sides of the two conductive elements in the form of a layer or sheet of clear casing material which spans flat against the exterior side of the respective conductive element to span across the open ends of the apertures formed in the core and the conductive elements. Accordingly flat coating layers can be provided spanning the exterior flat sides of the core while fully sealing and containing the light emitting diodes between the layers of casing material.

By arranging the core to protrude laterally outward beyond the opposing edges of both conductive elements, the outer layers of casing material can but are not required to wrap around the opposed edges 16 of the core to fully encase the light emitting diodes and resistors and conductive elements within protective material. The coating 32 is formed of a clear material permitting light transmission therethrough from the light emitting diodes which may be formed of the same material as the core 12, for example an insulating plastic material or polymer and the like.

In a preferred embodiment as shown in the accompanying figures, the light strip is formed by initially laminating the conductive elements to the opposing faces 14 of the core longitudinally along the length thereof. The light mounting apertures 18 and resistor mounting apertures 20 are punched through all of the layers of the core and conductive elements together so that the light emitting diodes and resistors can be inserted to the respective apertures after the conductive elements have already been mounted onto the appropriate faces 14 of the core.

The conductor apertures 30 can be formed by removing only the layers of the conductive elements from the core in a generally U-shaped path about each associated pair of light emitting diode and resistor. The U-shaped patterns which remove conductive material of the conductive elements from the periphery of the resistor and light mounting apertures core are oriented on the two conductive elements to be facing in opposing longitudinal directions relative to one another.

Accordingly, the light mounting aperture and LED mounted therein of each pair is fully isolated by an insulated gap on all sides relative to one of the conductive elements, but the associated resistor mounted in its respective resistor mounting aperture is only isolated on three sides by an insulating gap relative to the same conductive element. Conversely, the resistor and resistor mounting aperture within which it is mounted are isolated on all sides by an insulated gap relative to the conductive element on the opposing face of the core while the associated light emitting diode within its light mounting aperture is only insulated on three sides by an insulated gap relative to the same conductive element on the opposing side.

The conductor apertures are cut around the associated pair of mounting aperture and resistor mounting aperture to form the insulated gaps between the conductive elements and the light emitting diode and resistor received within the conductor aperture prior to the light emitting diode and resistor being mounted within their respective apertures. Once the light emitting diode and resistor are mounted within the respective apertures, connections can be made between the light emitting diode and the resistor, between the light emitting diode and the conductive element with which it is associated having no insulated gap therebetween, and between the resistor and the other conductive element with which it is associated by having no insulated gap therebetween.

After the connections of the LED's and resistors are made, a coating is applied in layers to the outer sides of the two conductive elements such that the coating material spans across the open ends of the aperture while the light emitting diodes and the resistors remain contained within respective voids in the core protected by the coating.

In further embodiments the light emitting diode and resistor of each associated pair may be connected with one another either before or after insertion into the core. In various embodiments, the apertures formed in the core may also be formed by various means at various steps in the manufacturing process. The light mounting apertures and resistor mounting apertures may be formed as separate apertures so that the resistor and associated light emitting diodes are each mounting within their own aperture as described above, or alternatively each light mounting aperture may be formed together with the associated resistor mounting aperture so that the light emitting diodes are mounted with the associated resistors within respective common apertures in the core. Furthermore the light mounting apertures and resistor mounting apertures may be formed prior to the conductive elements being bonded to the opposing faces 14 of the core so that the conductor apertures 30 are formed separately in alignment with existing apertures in the core, or alternatively as described above, the mounting apertures can be formed after the conductive elements are mounted in place on the core so that a common aperture is formed fully through the core and the two conductive elements together during manufacturing.

In yet further embodiments each light emitting diode may be coupled to the respective resistor and mounted on a carrier body which is then inserted within a common aperture in the core during manufacturing.

In yet further embodiments a plurality of light emitting diodes may be connected in series with one another in sets in which the sets are then in turn connected in parallel between the conductive elements rather than each individual light emitting diode being connected between the conductive elements directly in series with a respective resistor.

Figure 5:
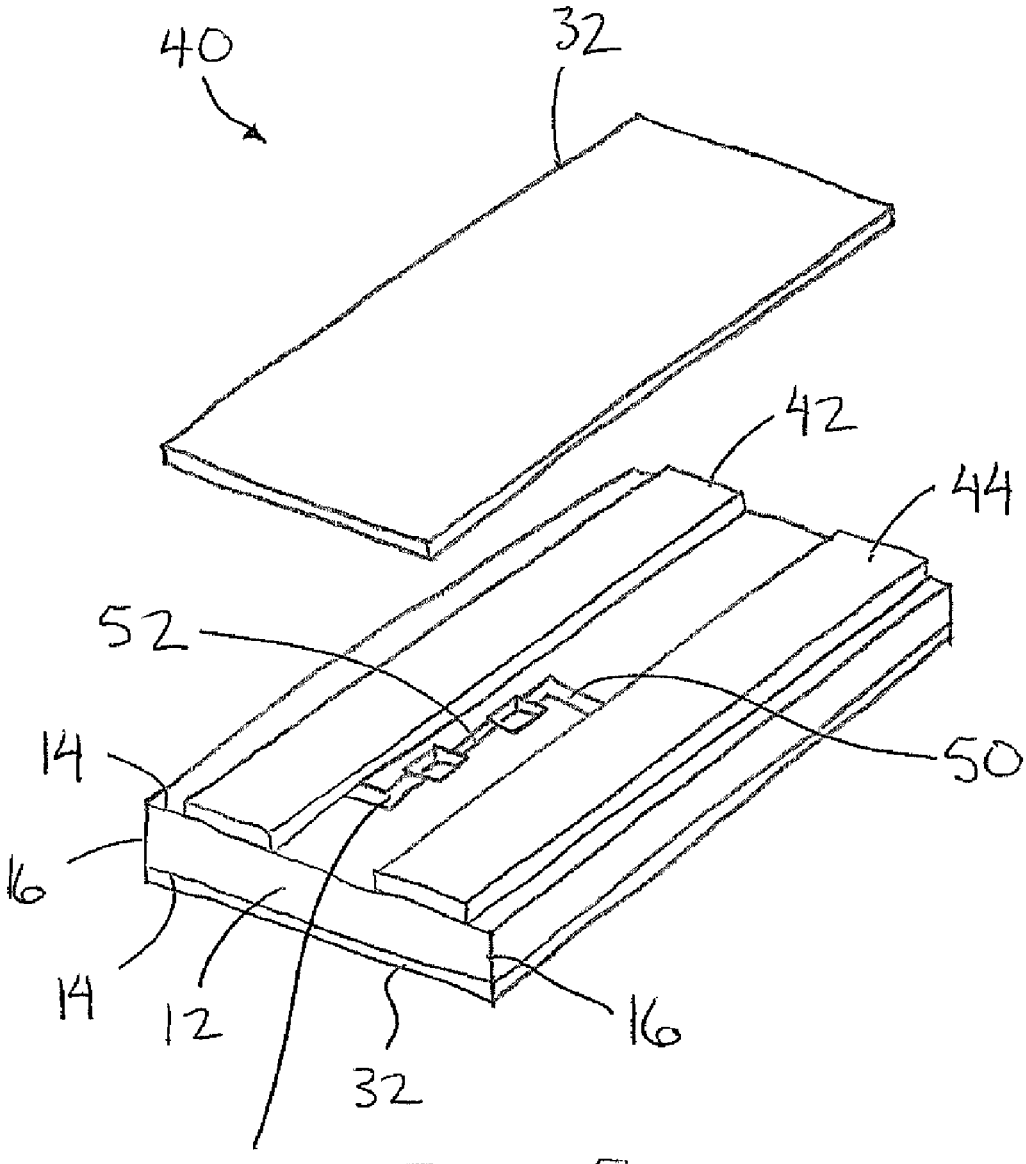
FIG. 5 is a perspective view of an alternative embodiment of a first side of a light strip.

Referring to the accompanying FIG. 5, there is illustrated an alternative embodiment of the light strip of the present invention. Similar to the light strip embodied in FIGS. 1 to 4, this light strip 40 includes a core 12 which forms the main body of the light strip. The core 12 extends in a longitudinal direction of the light strip and has a generally rectangular cross section defining two flat opposed faces 14 which extend in the longitudinal direction of the core and two much narrower edges 16 spanning between the two faces 14 along opposing edges thereof. The height of the edges 16 corresponding to the space between the two opposed faces 14 is much smaller than the overall width of the faces in a lateral direction between the two edges 16 so that the lateral width of the faces 14 is plural times greater than the space between the two faces as defined by the height of the edges 16.

The core 12 is elongate and formed of insulating material such as a polymer for example.

A plurality of light mounting apertures 18 are provided at spaced locations in the longitudinal direction along the core 12 of the light strip. Each light mounting aperture 18 extends fully through the core between the two opposed faces 14 at a location which is laterally centered between the two edges 16 of the core. Accordingly the light mounting apertures 18 are evenly spaced apart along the center of the core in alignment with one another in the longitudinal direction. Adjacent each light mounting aperture 18 there is also provided a resistor mounting aperture 20 in the core which extends similarly fully through the core between the two opposed faces 14 centrally spaced between the two edges 16 thereof in the lateral direction. The resistor mounting apertures 20 are accordingly similarly spaced apart in the longitudinal direction of the core of the strip.

A first conductive element 42 is provided for spanning along the top face 14 of the core in the longitudinal direction thereof along one side of the light mounting apertures 18, and a second conductive element 44 is provided for spanning also along the top face 14 of the core in the longitudinal direction thereof along the other side of the light mounting apertures 18. Each of the conductive elements comprises a flat band of conductive material mounted flat against face 14 of the core so that the two conductive elements are accordingly parallel and spaced apart from one another with the light emitting diode(s) (and resistor(s) where applicable) in between. Width of each conductive element in the lateral direction can be near to but less than one half of the width of the core. The conductive elements are secured to face 14 of the core by suitable adhesive means.

Each light mounting aperture 18 includes a light emitting diode received therein for connection between the two conductive elements such that all of the light emitting diodes are connected in parallel or in series with one another (depending on the power requirement of the light emitting diodes vis-a-vis the power supply). Thickness of the core between the two opposed faces 14 is arranged to be near or slightly greater than a maximum dimension of the light emitting diodes so that the light emitting diode can be fully recessed within the corresponding aperture.

A resistor is received (where required) within each of the resistor mounting apertures 20 in the core. Each resistor mounting aperture 20 is located directly adjacent a corresponding light mounting aperture so that each resistor can be connected in series via interconnecting conductive elements 50, 52, and 54, with a respective one of the LEDs with which it is associated. Each resistor is similarly fully recessed between the two opposed faces of the core and between the two conductive elements mounted on top face 14 respectively.

Once the light emitting diodes (and resistors) are connected between the two conductive elements secured to the opposing faces 14 of the core 12, a coating 32 can again be provided on the two opposed faces of the core in the form of a layer or sheet of clear casing material which spans flat against the exterior side of the respective conductive element to span across the open ends of the apertures formed in the core and the conductive elements. Accordingly flat coating layers can be provided spanning the exterior flat sides of the core while fully sealing and containing the light emitting diodes between the layers of casing material. The outer layers of casing material again can, but are not required to, wrap around the opposed edges 16 of the core to fully encase the light emitting diodes and resistors and conductive elements within protective material. The coating 32 is formed of a clear material permitting light transmission therethrough from the light emitting diodes which may be formed of the same material as the core 12, for example an insulating plastic material or polymer and the like.

Figure 6:
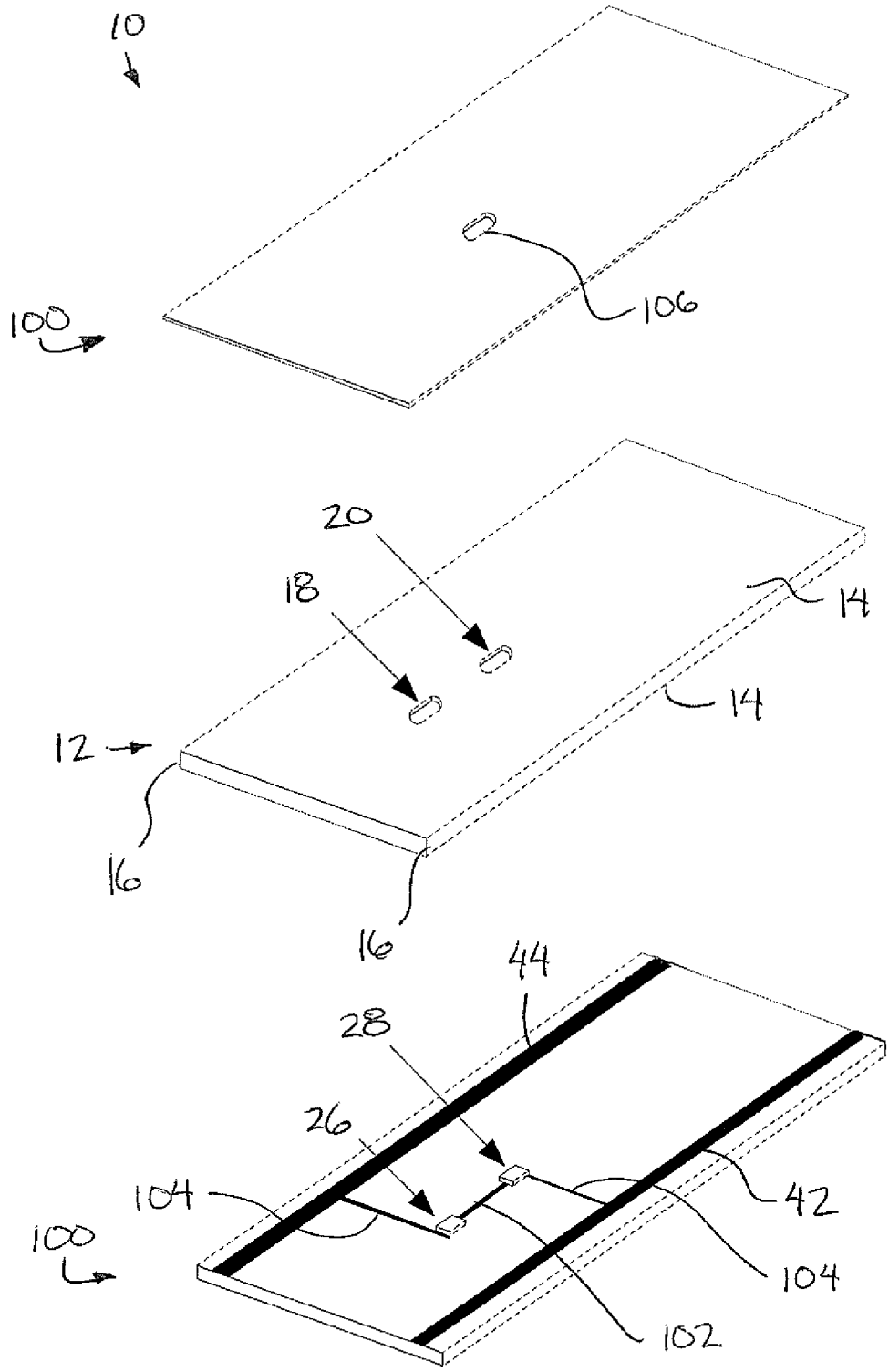
FIG. 6 is an exploded perspective view of a further embodiment of the light strip.

Turning now to the embodiment of FIG. 6, a further embodiment of the light strip 10 is shown which is substantially identical to the embodiment of FIG. 5 with the exception of the order of assembly. Accordingly as illustrated and described in the following, the light strip 10 according to FIG. 6 similarly comprises a core layer 12 having two opposed flat faces 14 which are much wider in a lateral direction across the faces than the thickness of the core between the two faces. Also as described above with regard to the previous embodiment, the strip according to FIG. 6 similarly comprises light mounting apertures 18 and resistor mounting apertures 20 at longitudinally spaced positions along the core layer, centered in the lateral direction between the opposed side edges 16 thereof.

As above, the mounting apertures 18 and 20 extend fully through the core layer by punching holes into an already formed strip of material. Also as described above the two conducting elements 42 and 44 are mounted such that the flat conductive strips forming the conductive elements lie in a generally common plane with one another lying parallel to the faces 14 of the core layer to extend in the longitudinal direction therewith adjacent the two edges 16 of the core layer respectively so as to be located spaced apart on opposing sides of the light mounting apertures and resistor mounting apertures centered therebetween.

The embodiment of FIG. 6 also comprises two cover layers 100 comprising preformed strip material similarly to the core layer 12 such that the two cover layers 100 can be mounted directly adjacent the two opposed faces 14 of the core layer respectively to resultingly span across the opposing open ends of the mounting apertures for enclosing the apertures and protecting the LED's 26 and resistors 28 mounted respectively therein as in the previous embodiments.

The embodiment of FIG. 6 differs from the previous embodiments in that the two conductive elements 42 and 44 are first positioned relative to one another in a generally common plane with the LED's 26 and resistors 28 connected therebetween prior to insertion of the LED's and resistors into the respective light mounting apertures 18 and resistor mounting apertures 20.

In the preferred embodiment illustrated in FIG. 6, the two conductive elements 42 and 44 are first mounted along the inner face of one of the cover layers 100 at laterally spaced apart positions adjacent the opposing side edges of the cover layer while being spaced inwardly slightly therefrom to permit the outermost edge of the layer to be bonded to adjacent layers with the conductive elements secured therebetween.

Conductive members 102 are provided which connect each LED 26 in series with the respective resistor 28 associated therewith in which the conductive members extend in the longitudinal direction at a central location in between the two conductive elements 42 and 44 in the common plane with the conductive elements.

To connect the LED's 26 between the two conductive elements 42 and 44, additional conductive members 104 connect between each LED 26 and one of the conductive elements as well as between the resistor 28 associated with that LED and the other conductive element. The conductive members 104 connected to the conductive elements 42 and 44 extend in the lateral direction between the opposing longitudinally extending edges of the cover layer such that all of the conductive members and the conductive elements together lie in common plane arranged to be secured between the adjacent cover layer and the corresponding face 14 of the core when the layers are assembled together.

The light mounting apertures 18 and resistor mounting apertures 20 are formed in the core layer for alignment with the LED's and resistors respectively when the two layers are assembled together using suitable adhesive therebetween. The thickness of the core layer corresponds closely to a maximum dimension of the LED or resistor to minimize the overall thickness required. The other cover layer 100 is secured along the opposing face 14 of the core layer opposite the conductive elements 42 and 44 to span across the ends of the mounting apertures in the core such that the two cover layers together enclose both ends of each aperture. The second cover is also secured by suitable adhesive so that all three layers can be bonded together without subjecting the LED's, the resistors, or any of the conductive members or elements to any considerable heat or damaging pressure typically required when protective coatings or resins are applied to or extruded about electronic components as in many prior art light strip designs.

In a preferred arrangement, the core layer 12 has a thickness between the two opposed faces 14 thereof which is near the maximum dimension of the LED or resistors so that the LED's and resistors can be fully received between the two opposed faces while minimizing the thickness of the core layer. The two cover layers in this instance each preferably have a thickness which is less than the core layer to yet further minimize the overall assembly of layers.

In a typical embodiment, both cover layers 100 and the core layer 12 are formed of like material, for example a common plastic material formed from preformed manufactured strip material having a similar width in the lateral direction so that when the layers are assembled with one another by suitable adhesive, the LED's and resistors are fully protected within the respective mounting apertures and the resulting outer finished surfaces of the strip defined by the outer surfaces of the cover layers 100 is flat and the overall cross section remains generally rectangular so that when pressure is applied to the strip, all of the weight is carried structurally by the core layer between the two cover layers to isolate and protect the LED's and resistors.

In preferred embodiments all three layers comprise a translucent or transparent flexible material to transmit light of the LED's therethrough while resulting in the overall construction of the strip remaining highly flexible and adaptable to different mounting installations.

In some embodiments, one of the cover layers 100 comprises an opaque material layer or has an additional layer of opaque material applied to the outer side thereof which includes a decorative outer finish, for example a decorative pattern or color for blending into a surrounding supporting surface upon which the light strip is to be mounted. In this instance, a plurality of transparent viewing panes 106 are formed in the opaque layer in alignment with the light emitting diodes respectively so that the light from the diodes can still be transmitted through the layer while all of the conductive members and conductive elements, together with the resistors, are disguised and hidden from view by the opaque layer.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A light strip comprising:

an elongate core layer of insulating material having an outer surface comprising two opposed faces extending in a longitudinal direction of the core layer;

at least one light mounting aperture extending through the core layer between the two opposed faces of the core layer;

two conductive elements extending in the longitudinal direction along the outer surface of the elongate core layer;

a plurality of light emitting diode assemblies connected between the two conductive elements and received in said at least one light mounting aperture in the core layer;

a resistive assembly connected with each light emitting diode assembly between the two conductive elements;

a plurality of resistor mounting apertures extending through the core layer independently of the light mounting apertures of the respective light emitting diode assemblies, each resistor mounting aperture receiving a respective one of the resistive assemblies therein; and a cover layer spanning in the longitudinal direction adjacent each one of the two opposed faces of the elongate core layer.

2. The light strip according to claim 1 wherein said at least one light mounting aperture comprises a plurality of light mounting apertures spaced apart from one another in the longitudinal direction of the core layer, each light mounting aperture locating one of the light emitting diode assemblies therein.

3. The light strip according to claim 1 wherein there is provided a conductive member connecting each light emitting diode assembly with the respective resistor connected in series therewith, each conductive member lying in a plane between the core layer and one of the cover layers adjacent thereto.

4. The light strip according to claim 3 wherein the conductive elements each comprise a flat strip of conductive material and wherein all of the conductive members connected between the light emitting diode assemblies and the respective resistor lie in a substantially common plane with the conductive elements between the core layer and one of the cover layers adjacent thereto.

5. The light strip according to claim 1 wherein there is provided a conductive member connecting each light emitting diode assembly to each one of the conductive elements, each conductive member lying in a plane between the core layer and one of the cover layers adjacent thereto.

6. The light strip according to claim 5 wherein the conductive elements each comprise a flat strip of conductive material and wherein all of the conductive members connecting the light emitting diode assemblies to the conductive elements lie in a substantially common plane with the conductive elements between the core layer and one of the cover layers adjacent thereto.

7. The light strip according to claim 1 wherein each one of the conductive elements comprises a flat strip of conductive material lying flat against one of the two opposed faces of the elongate core layer.

8. The light strip according to claim 7 wherein the conductive elements lie in a substantially common plane.

9. The light strip according to claim 7 wherein the conductive elements lie in a substantially common plane between the core layer and one of the cover layers adjacent thereto.

10. The light strip according to claim 1 wherein each light emitting diode (assembly) is fully recessed between the two opposed faces of the core layer.

11. The light strip according to claim 1 wherein the two opposed faces have a thickness therebetween that is near a maximum dimension of the light emitting diode assemblies.

12. The light strip according to claim 1 wherein the core layer is generally flat such that a width of the core layer in a lateral direction along the faces perpendicular to the longitudinal direction is many times greater than a thickness of the core layer between the two opposed faces.

13. The light strip according to claim 1 wherein each cover layer comprises a preformed strip of material attached to the respective face of the core layer.

14. The light strip according to claim 1 wherein the cover layers each comprise a continuous strip of material spanning in the longitudinal direction such that said at least one light mounting aperture is enclosed at both opposed faces of the core layer by the cover layers spanning thereacross respectively.

15. The light strip according to claim 1 wherein the core layer and both cover layers have a similar width in a lateral direction along the faces of the core layer perpendicular to the longitudinal direction.

16. The light strip according to claim 1 wherein the cover layers each have a smaller thickness than a thickness of the core layer between the two opposed faces thereof.

17. The light strip according to claim 1 wherein the core layer and both cover layers are formed of flexible insulating material.

* * * * *